United States Patent [19]

Kalpins

[11] 3,986,367

[45] Oct. 19, 1976

[54] EARTHQUAKE-RESISTANT ANCHORING SYSTEM

[76] Inventor: Alexandrs K. Kalpins, 501 Fifth Ave., Suite 1201, New York, N.Y. 10017

[22] Filed: Oct. 1, 1975

[21] Appl. No.: 618,493

[52] U.S. Cl. ..... 61/100; 52/167

[51] Int. Cl.[2] ..... E02D 27/34; E02D 27/50

[58] Field of Search ..... 52/167; 61/46, 46.5, 61/50

[56] References Cited

UNITED STATES PATENTS

| | | | |
|---|---|---|---|
| 2,055,000 | 9/1936 | Bacigalupo | 52/167 |
| 2,828,589 | 4/1958 | Hercik | 52/167 |
| 3,748,800 | 7/1973 | Glicksberg | 52/167 |

FOREIGN PATENTS OR APPLICATIONS

| | | | |
|---|---|---|---|
| 936,428 | 9/1963 | United Kingdom | 52/167 |

*Primary Examiner*—Jacob Shapiro

[57] ABSTRACT

A structural body such as a nuclear power plant, or the like, can be anchored in an earthquake-resistant manner by supporting the structural body onto a support means so that relative horizontal movement between the body and the support means can take place in all directions. Frictional force generated between the structural body and the support means is less than the force required to move the structural body together with the support means when the latter is subjected to a force having a horizontal component.

11 Claims, 12 Drawing Figures

EARTHQUAKE-RESISTANT ANCHORING SYSTEM

BACKGROUND OF THE INVENTION

This invention relates to earthquake-resistant anchoring systems.

Earthquakes comprise horizontal and vertical ground vibrations. During an earthquake, structural bodies such as buildings, nuclear power plants, oil and chemical storage tanks, and the like structures, which are connected to the earth by conventional foundations are subjected to forced vibrations which are imposed onto these structural bodies by the movement of their respective foundations. The inertia of the structural body tends to resist the earthquake-induced movements of the foundation. As a result, a lateral shearing force (base shear) is applied to the structural body at its foundation. The magnitude of this base shear is a major factor in earthquake damage and is the principal concern of the structural designer. Inasmuch as the forces to which a structural body is subjected during an earthquake are directly proportional to the mass of the structural body, these forces can be minimized to some extent through the utilization of lightweight materials of construction and by designing structures of relatively low total weight; however, the structural designer is limited in his approaches because of the types and cost of currently commercially available materials of construction.

In the case of a nuclear power facility, potential earthquake damage constitutes a special safety problem because of the possibility that fission products may be released. Accordingly, a relatively higher safety factor is required to avoid the possibility of exposing the population to excessive radiation.

The usual design approach is to use available materials and to size all structural members so as to withstand an earthquake of predetermined level of severity. It has to be kept in mind, however, that earthquakes do not have a "windward" side or a "leeward" side, thus each and every structural body or object has to be secured against earthquake-generated forces. While in the case of buildings the vertical vibrations generated during an earthquake are relatively small and may be disregarded for design purposes, in a nuclear power plant the effects of vertical as well as horizontal vibrations have to be combined directly and linearly with sources of stress from dead load, live load, thermal effects, pressures, and other applicable operating conditions and loadings when determining the design maxima for all sources of stress that may be encountered. The net results are very high design and construction costs.

The present invention obviates or at least minimizes many of the aforementioned difficulties and provides an earthquake-resistant anchoring system whereby the stresses to which a structural body is subjected during an earthquake can be attenuated. Moreover, the present invention provides a system which can be constructed at a relatively low cost. Also, the present anchoring system provides an elastic connection between the structural body and the earth which does not transmit vibrations to the structural body but which effectively immobilizes the structural body.

SUMMARY OF THE INVENTION

The present invention contemplates an earthquake-resistant anchoring system in which a structural body is nonrigidly, i.e., elastically or gravitationally, connected by a particular support means to the earth. The abutting surfaces of the structural body and the support means have a relatively low coefficient of friction so that the support means for the structural body can move horizontally in response to an applied force while the supported structural body remains substantially stationary.

The system comprises a structural body having a base, a support means for the structural body abutting the base, earth-connected, fixed foundation means surrounding the structural body in a spaced relationship therefrom, rigid hanging element means in a spaced relationship from the structural body, flexible elongated connector means which join the structural body with said hanging element means and which permit substantially independent relative motion between the structural body and the hanging element means, and anchoring means which peripherally connect the hanging element means to the fixed foundation means.

The support means restrains vertical movement of the structural body in response to gravitational force but permits relative movement between the structural body and the support means in all horizontal directions. Contiguous surfaces of the structural body base and the support means are movable relative to one another and, upon application to the support means of a force having a horizontal component, generates a frictional force of a magnitude which is less than the magnitude necessary to move the structural body together with the support means. The flexible, elongated connector means which join the structural body with the hanging element means are adapted to oppose horizontal movement of the structural body when the connector means are flexed. Likewise, in embodiments where the anchoring means are flexible they complement the action of the flexible connector means in opposing horizontal movement of the structural body. Preferably the flexible connectors are prestressed.

Preferred support means for the purposes of the present invention are those which cause minimal friction between the base of the structural body and the contiguous surface of the support means. Particularly preferred support means are a natural or man-made pool of liquid such as water, or a plurality of rollably positioned balls which define a planar bearing surface for the base of the structural body.

DESCRIPTION OF PREFERRED EMBODIMENTS

Figure 1:
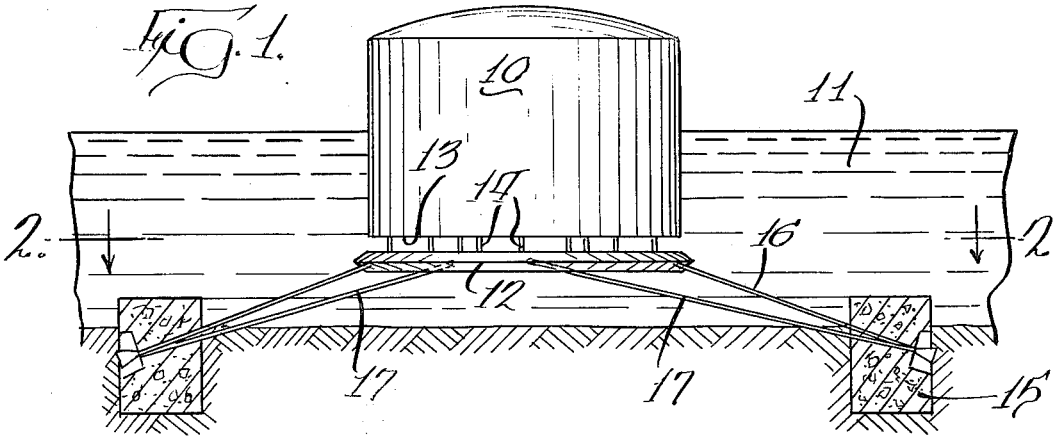
FIG. 1 is an elevational view, partly in section, showing a structural body, such as a nuclear reactor, positioned in a pool of liquid and anchored in accordance with the present invention.
Figure 2:
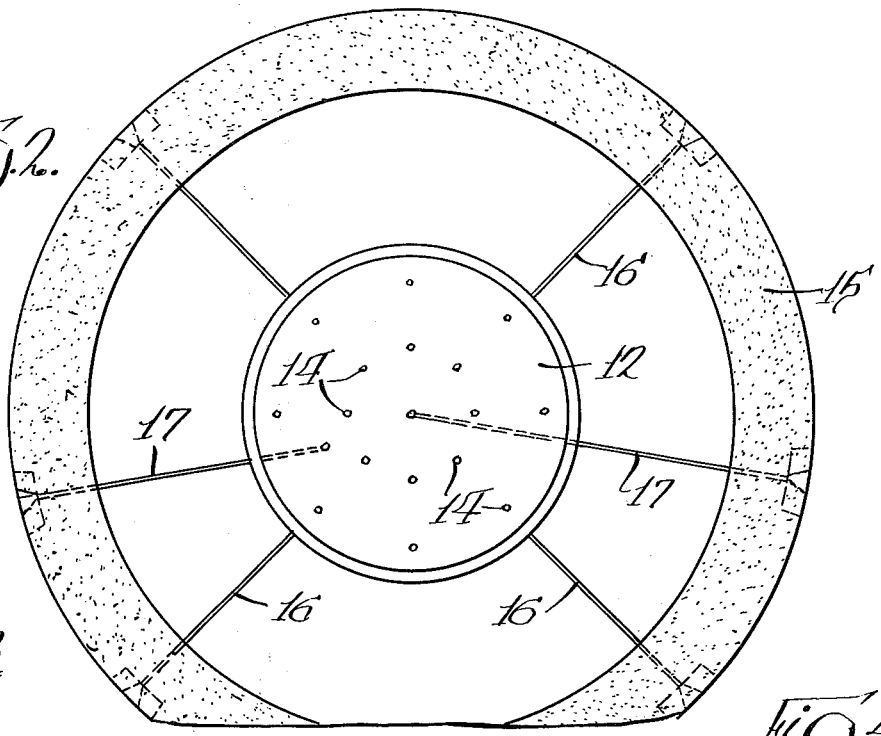
FIG. 2 is a fragmentary sectional view taken along plane 2—2 in FIG. 1.

Referring to FIGS. 1 and 2, a structural body such as nuclear reactor 10 is shown floating in natural body of water 11. Circular planar member 12 which can be a plate, frame, or the like made from concrete, steel, or any other material compatible with the environment, serves as a hanging element, is submerged in body of water 11 and depends downwardly from base 13 of reactor 10. Flexible elongated connector means such as cables 14, which act together regardless of the direction of the induced stresses, join or connect planar member 12 with reactor 10 and retain planar member 12 in a spaced relationship from base 13. As shown in FIG. 2, cables 14 are disposed in a pattern of concentric circles; however, any other arrangement can be used.

Fixed earth-connected foundation means in the form of a concrete ring 15 spaced from base 13 surrounds reactor 10, and anchoring means which can be prestressed flexible cables or rods 16 peripherally connect planar member 12 with concrete ring 15. If desired, additional prestressed flexible cables 17 provide further connections between planar member 12 and ring 15. Conventional prestressed concrete techniques can be utilized to secure the cables or rods.

In the event of an earthquake, the elements that are influenced by the earthquake-induced vibrations are concrete ring 15, flexible cables or rods 16 and 17, planar member 12, and cables 14. Because of the relatively large mass of reactor 10 and the elastic connection thereof with vibrating mass of planar member 12 reactor 10 remains substantially immobile. Inasmuch as water has very low resistance to shear, wave action in pool 11 also has an insignificant effect.

Flexible connectors and anchoring means such as cables 14 and prestressed cables 16 and 17 maintain upright reactor 10 in a substantially vertical position also during strong windstorms, tornadoes, hurricanes, and the like. Reactor 10 is connected to planar member 12 by means of relatively short, elastic cables. As a result, reactor 10 can resiliently move in any horizontal direction when subjected to an external force having a horizontal component. Besides, because of such an elastic connection, any shift in reactor position that may take place will take place in a horizontal plane, and the anchored structure will readily withstand also the dynamic forces of wind or the like. A swinging movement, very undesirable for sensitive instruments, is thereby avoided.

The prestressed cables or rods utilized in the present anchoring system can be readily replaced without special tools should it become necessary to do so at any point in time. Additionally, the number of prestressed cables or rods that are used in any given installation is selected so that should any cable or rod fail, the remaining cables or rods can adequately carry the load until replacement can be effected. The weight contributed by the cables to the overall system weight is minimal.

Minor variations of liquid level in the pool in which the structural body floats are compensated by the prestressed cables so that the relative position of the structural body remains practically constant at all times. To compensate for major changes in liquid level, e.g., tides, the prestressed cables or rods can be equipped with automatic compensating means which lengthen or shorten the cables as required to maintain a predetermined stress. In the latter instance the vertical position of the structural body relative to earth will, of course, change.

Figure 3:
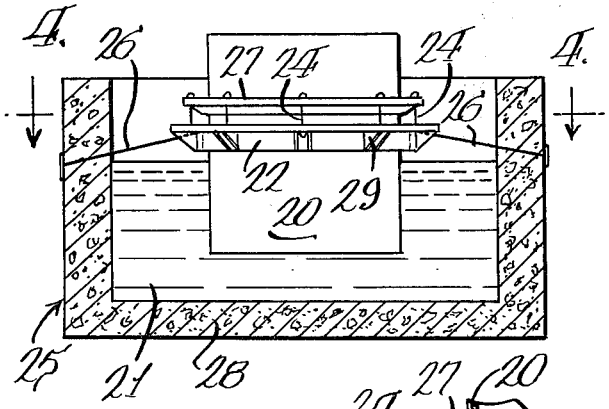
FIG. 3 is an elevational view, partly in section, showing another embodiment of the present invention.
Figure 4:
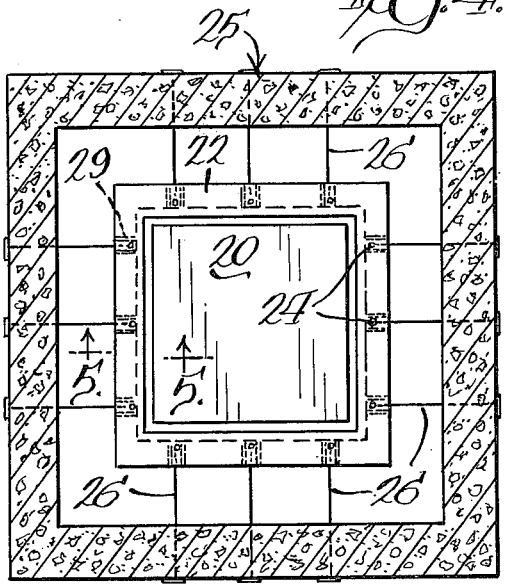
FIG. 4 is a sectional view taken along plane 4—4 in FIG. 3.
Figure 5:
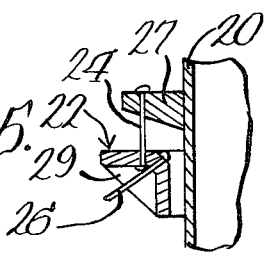
FIG. 5 is a fragmentary sectional view taken along plane 5—5 in FIG. 4 and showing a connector detail.

Another embodiment of the present invention utilizing an annular or frame-like rigid hanging element which surrounds the structural body is illustrated in FIGS. 3, 4 and 5 and which is free to vibrate or oscillate in response to an earthquake without transmitting or inducing vibrations or oscillations in structural body 20. Box-like structural body 20 having a relatively large mass is immersed and floats in liquid pool 21 contained within concrete basin 25 the upstanding walls of which surround structural body 20 and provide convenient anchoring points for flexible anchoring cables 26 which extend substantially radially outwardly and downwardly from rigid hanging element 22 and which are secured to the earth-connected basin 25. When a concrete basin is used to contain the liquid pool, soil conditions are of minor significance. Moreover, in the case of a circular basin the downwardly sloping anchoring cables also serve to distribute forces to the bottom wall 28 of basin 25 and minimize the incidence of cracks in basin 25.

The rigid hanging element in this instance is rigid collar 22 having an inverted L-shaped cross section (FIG. 5) and a plurality of peripherally-spaced reinforcing webs 29 positioned at connecting points for anchoring cables 26. Collar 22 is positioned around structural body 20 but is spaced from the lateral surfaces thereof. The material of construction for collar 22 is not critical; however, the rigidity of collar 22 is such that collar 22 remains substantially undeformed under the influence of the stresses generated by wind, earthquake, and other phenomena. The spacing in any given instance is selected so that even under the anticipated vibrations due to an earthquake and the attendant movement of collar 22 a space remains between collar 22 and body 20. Compared to the mass of structural body 20 the mass of collar 22 is very small. Peripheral circumferential flange 27 is fixedly attached to structural body 20 and provides a convenient means for securing the upper end of flexible connector cables 24 to structural body 20. The lower end of flexible cables 24 is secured to collar 22 so that collar 22 depends downwardly from flange 27. Flexible cables 24 are held relatively taut due to the buoyant forces of displaced liquid in pool 21 which urges structural body 20 upwardly while collar 22 is held down by peripherally positioned flexible anchoring cable 26. As a result of the foregoing connections and the spacing between collar 22 and structural body 20, substantially independent movement between collar 22 and body 20 is achieved.

Figure 6:
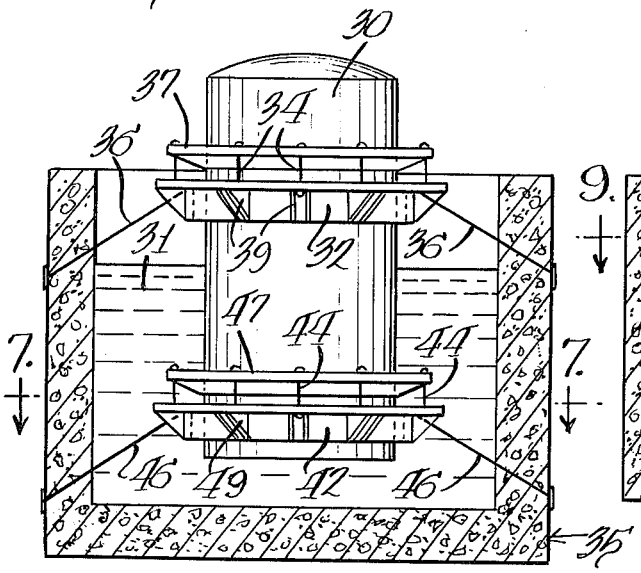
FIG. 6 is an elevational view, partly in section, illustrating an embodiment of this invention utilizing a double anchoring system.
Figure 7:
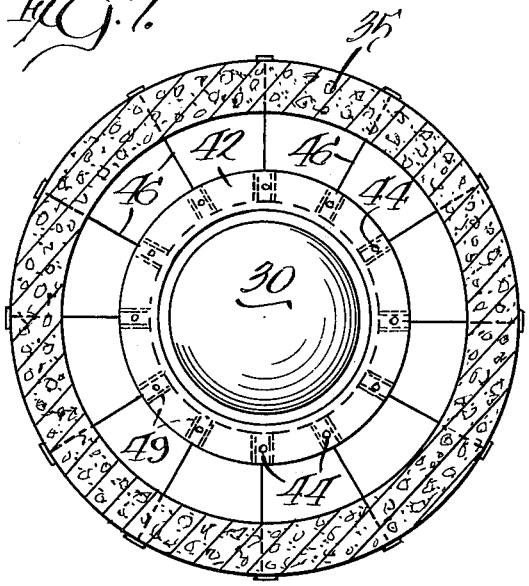
FIG. 7 is a sectional view taken along plane 7—7 in FIG. 6.

More than one anchoring system can be employed in instances where an elongated upright structure has to be anchored so that swaying is minimized. A dual anchoring system for a cylindrical tank is illustrated in FIGS. 6 and 7. Vertical tank 30 is provided with a pair of vertically-spaced, peripheral flanges 37 and 47 which are welded or otherwise secured to the lateral surface of tank 30. Collars 32 and 42 are reinforced by webs 39 and 49 and are hung from flanges 37 and 47, respectively, by means of respective flexible connector cables 34 and 44. Tank 30 floats in pool of liquid contained within concrete basin 35 and collar 32 is anchored to basin 35 above the level of liquid therein by flexible cables 36 while collar 42 is similarly anchored to basin 35 below the liquid level by flexible cables 46.

Figure 8:
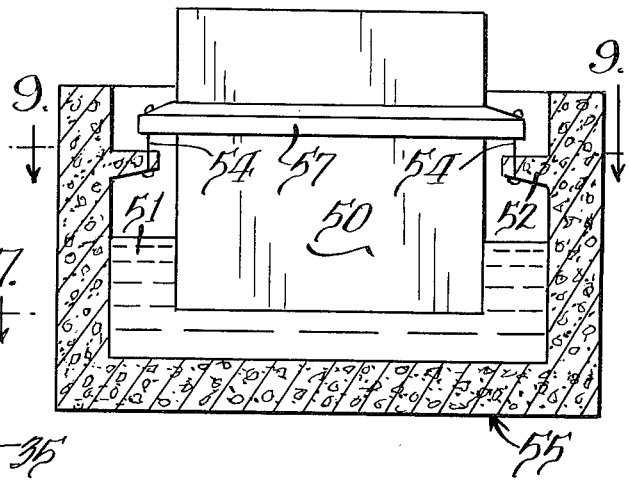
FIG. 8 is an elevational view, partly in section, illustrating a further embodiment of this invention.
Figure 9:
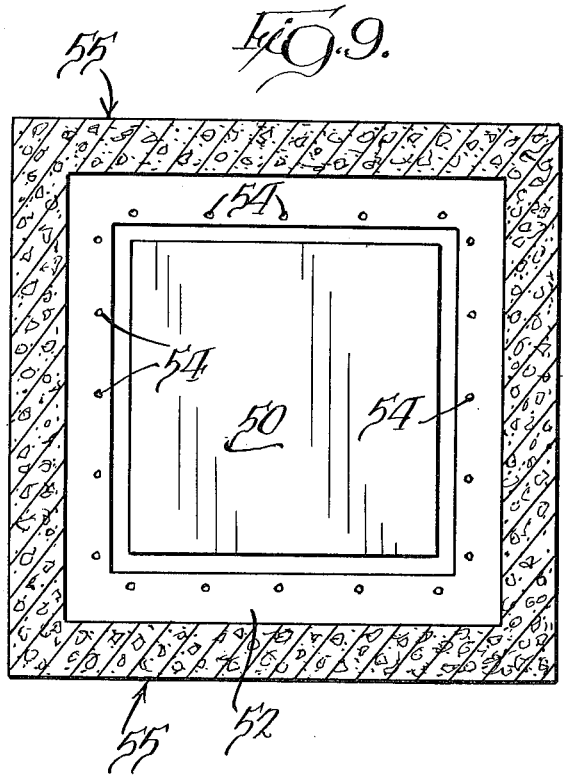
FIG. 9 is a sectional view taken along plane 9—9 in FIG. 8.

In regions where severe earthquakes are not likely, the hanging element can be rigidly anchored to the earth-connected foundation by casting the hanging element in concrete integral with the fixed foundation or by rigidly bolting the hanging element to the foundation. An anchoring system of this particular type is illustrated in FIGS. 8 and 9 wherein structure 50 floats in liquid pool 51 contained within concrete basin 55 the upstanding walls of which are provided with an integral peripherally projecting ridge 52 which serves as the hanging element. Flexible connector cables 54 join peripheral flange 57 of structure 50 to ridge 52, and the buoyant force of liquid in pool 51 maintains cables 54 in tension.

Figure 10:
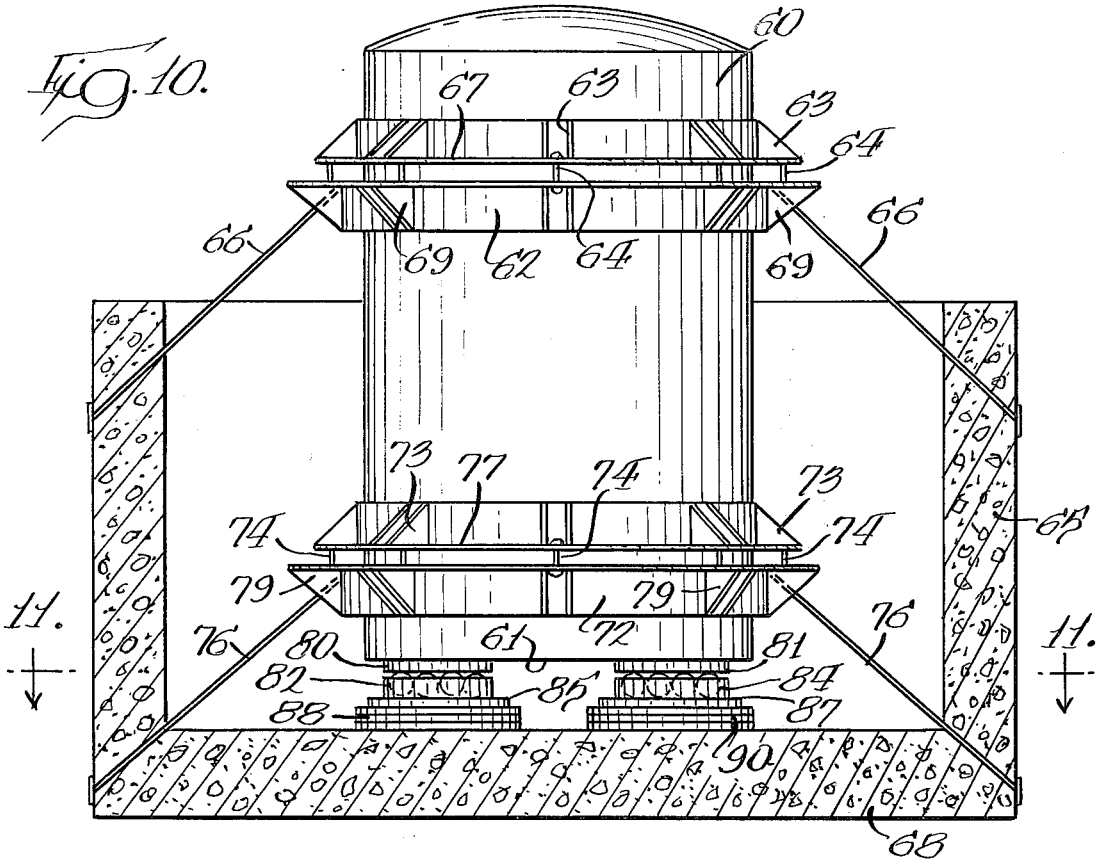
FIG. 10 is an elevational view, partly in section, illustrating yet another embodiment of the present invention.
Figure 11:
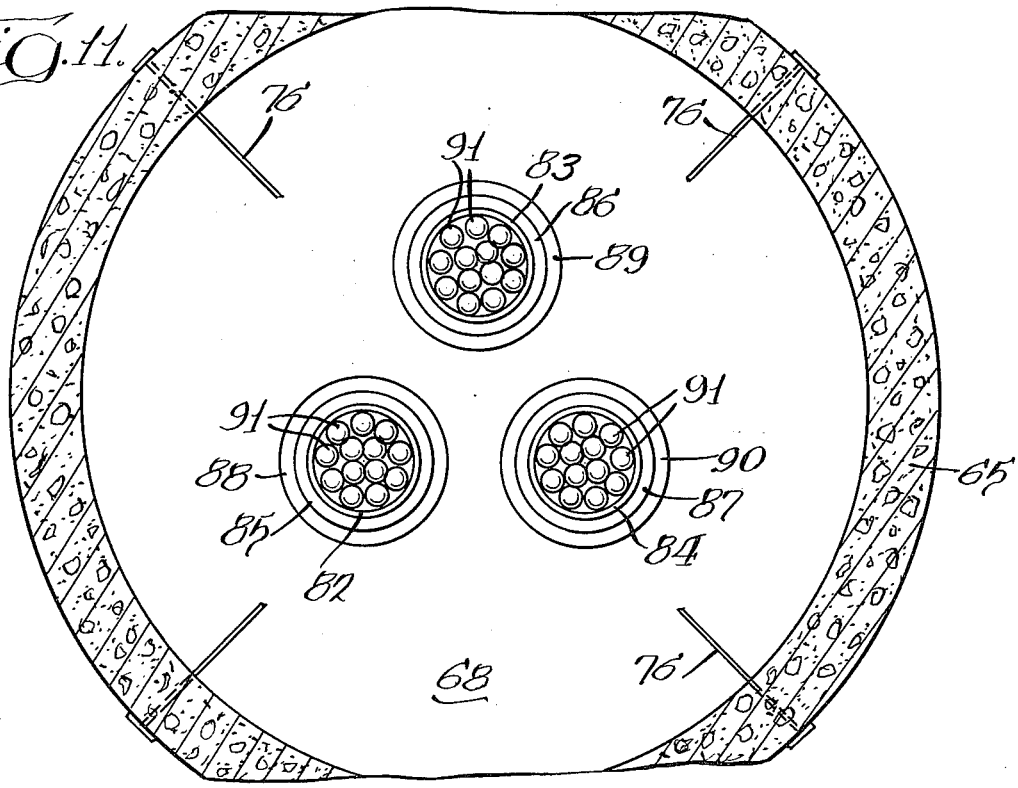
FIG. 11 is a fragmentary sectional view taken along plane 11—11 in FIG. 10.

Another low friction-type support means for a structural body utilizes a plurality of rollably positioned balls which together define a planar bearing surface for the base of the structural body. An anchoring system of this particular type is illustrated in FIGS. 10 and 11. Base 61 of reactor vessel 60 is provided with a plurality of smooth, hard support pads such as pads 80 and 81 made of steel plates or the like which rest on a plurality of round balls 91 contained within ring-like retaining collars 82, 83 and 84. Ball bearings such as balls 91 in each of the groupings defined by retaining collars 82, 83 and 84 define a planar bearing surface for base 61. To minimize rolling friction, relatively hard steel base plates 85, 86 and 87 can be provided below balls 91 in each of the aforementioned groupings. Also, resilient cushioning pads 88, 89 and 90 made of teflon or a similar resilient can be provided between base plates 85, 86 and 87 on one hand and bottom wall 68 of foundation 65 to minimize the transmission of vertical vibrations to reactor vessel 60. Resilient cushioning pads 88, 89 and 90 can also have a sandwich-type construction having alternating steel plates and sheets of a resilient material.

Figure 12:
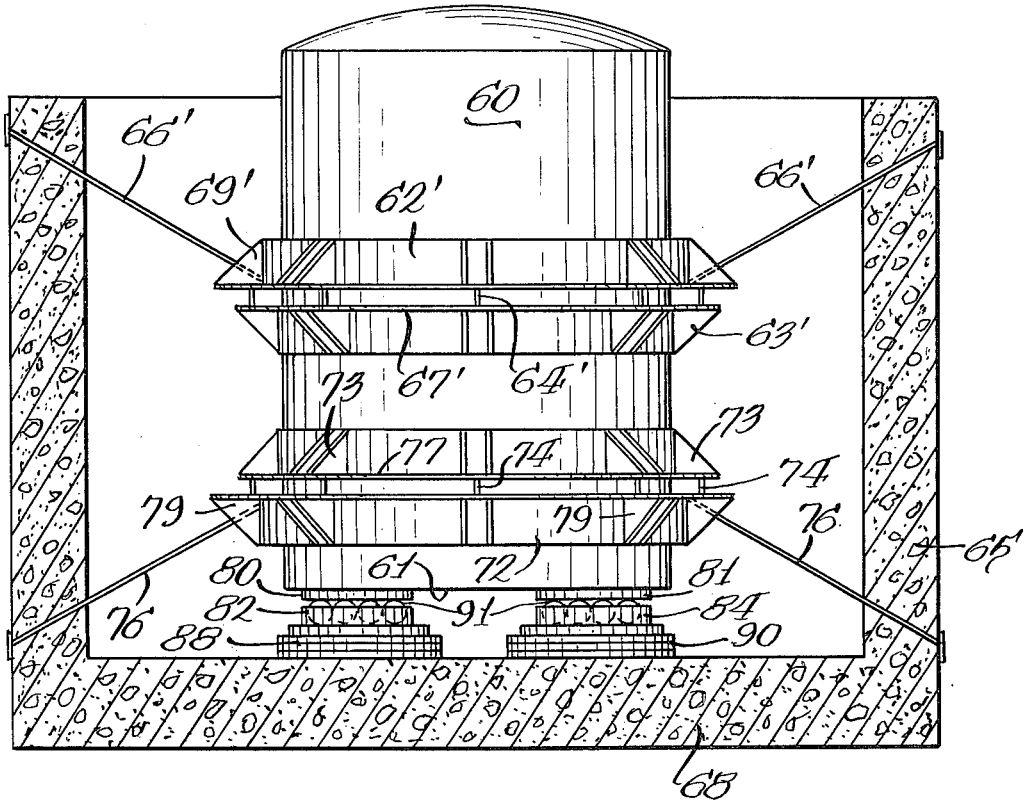
FIG. 12 is an elevational view, partly in section, illustrating a still further embodiment of this invention.

Vertically-spaced flanges 67 and 77 are affixed to reactor vessel 60 and can be provided with appropriate peripherally spaced reinforcing webs 63 and 73. One end of relatively short flexible cables 64 and 74 is secured to respective flanges 67 and 77 and the other end of cables 64 and 74 is secured to collars 62 and 72 which hang from flanges 67 and 77 respectively and which are in spaced relationship from the lateral surface of reactor vessel 60. Spaced reinforcing flanges 69 and 79 are welded to respective rigid collars 62 and 72 which collars, in turn, are anchored to foundation 65 by means of radially downwardly extending flexible cables 66 and 76 to provide an elastic coupling of reactor vessel 60 to foundation 65 and thus to the earth. Alternatively, the relative positions of collar 62 and flange 67 can be inverted and the anchoring points of radial flexible cables 66 to foundation 65 elevated to a position above the level of collar 62 so that collar 62 is suspended by flexible cables 66 which extend radially upwardly above rigid collar 62. This is illustrated in FIG. 12 with the inverted parts having the same numeral designation as in FIG. 10 but with a prime notation. In the embodiment shown in FIG. 12 balls 91 do not bear the full load of reactor vessel 60 because part of the load is carried by prestressed flexible cable 66'.

When an anchoring system of the type illustrated in FIGS. 10 and 11 receives a shock wave from an earthquake or a similar disturbance, the planar bearing surface defined by balls 91 is not capable of transmitting to reactor 60 the earthquake-induced vibrations of foundation 65 because of the relatively low friction in all directions between the planar bearing surface and the support pads such as 80 and 81. As a result, reactor vessel 60, due to its relatively large mass remains substantially motionless regardless of the direction of the earthquake-induced forces.

The foregoing discussion and the drawings showing various embodiments of the invention are intended as illustrative and are not to be taken as limiting. Still other variations and rearrangements of parts are possible without departing from the spirit and scope of the present invention as will be apparent to one skilled in the art.

I claim:

1. An earthquake-resistant anchoring system which comprises a structural body having a base;

support means abutting said base and restraining vertical movement of said structural body in response to gravitational force but permitting relative movement between said structural body and said support means in all horizontal directions, said base and said support means having contiguous surfaces movable relative to one another which surfaces, upon application to the support means of a force having a horizontal component, generate a frictional force having a magnitude which is less than the magnitude necessary to move said structural body together with said support means;

earth-connected fixed foundation means surrounding said structural body in a spaced relationship therefrom;

rigid hanging element means in a spaced relationship from said structural body;

flexible elongated connector means joining said structural body with said rigid hanging element means and permitting substantially independent relative motion between said structural body and said hanging element means; and anchoring means peripherally connecting said hanging element means to said fixed foundation means;

said flexible elongated connector means being adatped to oppose horizontal movement of said structural body when said connector means are flexed.

2. The anchoring system in accordance with claim 1 wherein said anchoring means are prestressed flexible cables extending radially outwardly from said hanging element means.

3. The anchoring system in accordance with claim 1 wherein said hanging element means is rigidly connected to said fixed foundation means.

4. The anchoring system in accordance with claim 1 wherein said support means is a pool of liquid within which said structural body is immersed and floats.

5. The anchoring system in accordance with claim 1 wherein said support means is a plurality of balls defining a planar bearing surface for said base.

6. The anchoring system in accordance with claim 5 wherein at least three separate groupings of balls are provided and wherein the balls in each of said groupings are held together by a ring-like retaining collar.

7. The anchoring system in accordance with claim 1 wherein said hanging element means comprises a rigid annular collar surrounding but spaced from said structural body.

8. The anchoring system in accordance with claim 1 wherein said structural body floats in a liquid pool, wherein said hanging element means comprises a planar member substantially coextensive with said base and spaced therefrom, wherein a plurality of flexible cables joins said planar member and said base so that the planar member depends from said base, and wherein a plurality of flexible cables extends downwardly and radially outwardly from said planar members and flexibly connects said planar member to said fixed foundation means.

9. The anchoring system in accordance with claim 1 wherein said structural body is provided with an integral peripheral flange, wherein said hanging element means comprises an annular collar surrounding said structural body, wherein a plurality of flexible cables join said flange to said annular collar so that the collar depends from said flange, and wherein a plurality of flexible cables extends radially outwardly and downwardly from said annular collar and joins the collar to said fixed foundation means.

10. The anchoring system in accordance with claim 9 wherein a plurality of vertically-spaced, integral peripheral flanges and a plurality of hanging element means are provided and wherein each flange is joined to one of said hanging element means.

11. The anchoring system in accordance with claim 9 wherein said structural body is provided with an additional integral peripheral flange positioned above said first-mentioned integral peripheral flange, wherein a second hanging element means comprising an annular collar which surrounds said structural body is suspended above said additional integral peripheral flange and is joined to said fixed foundation means by means of a plurality of radially-upwardly extending flexible cables, and wherein said second hanging element is joined to said additional integral peripheral flange by a plurality of flexible cables.

* * * * *